US006948244B1

(12) United States Patent
Crockett

(10) Patent No.: US 6,948,244 B1
(45) Date of Patent: Sep. 27, 2005

(54) METHOD OF MOLDING FLUIDIC OSCILLATOR DEVICES

(75) Inventor: Steven Crockett, Hampstead, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 338 days.

(21) Appl. No.: 10/091,347

(22) Filed: Mar. 6, 2002

Related U.S. Application Data

(60) Provisional application No. 60/273,326, filed on Mar. 6, 2001.

(51) Int. Cl.[7] ..... B21K 21/08; B05B 1/08

(52) U.S. Cl. ..... 29/890.142; 29/890.143; 137/826; 137/833; 239/589.1; 239/600

(58) Field of Search ..... 29/890.142, 890.143; 239/589.1, 600; 137/833, 826, 803; 264/328.1

(56) References Cited

U.S. PATENT DOCUMENTS

| | | | | | |
|---|---|---|---|---|---|
| 3,459,847 | A | * | 8/1969 | Hawgood et al. | 264/219 |
| 4,185,777 | A | | 1/1980 | Bauer | 239/394 |
| 4,231,519 | A | * | 11/1980 | Bauer | 239/589.1 |
| 4,260,106 | A | * | 4/1981 | Bauer | 239/11 |
| 4,304,749 | A | * | 12/1981 | Bauer | 264/263 |
| 4,694,992 | A | * | 9/1987 | Stouffer | 239/265.23 |
| RE33,158 | E | * | 2/1990 | Stouffer et al. | 239/589.1 |
| RE33,159 | E | * | 2/1990 | Bauer | 239/589.1 |
| 5,213,269 | A | | 5/1993 | Srinath et al. | 239/589.1 |
| 5,820,034 | A | * | 10/1998 | Hess | 239/589.1 |
| 5,845,845 | A | * | 12/1998 | Merke et al. | 239/1 |
| 5,906,317 | A | * | 5/1999 | Srinath | 239/284.1 |
| 5,928,594 | A | * | 7/1999 | Foster | 264/255 |
| 5,971,301 | A | * | 10/1999 | Stouffer et al. | 239/589.1 |
| 6,186,409 | B1 | * | 2/2001 | Srinath et al. | 239/1 |
| 6,408,866 | B1 | * | 6/2002 | Carver et al. | 137/15.01 |
| 6,457,658 | B2 | * | 10/2002 | Srinath et al. | 239/589.1 |
| 6,497,375 | B1 | * | 12/2002 | Srinath et al. | 239/589.1 |
| 6,575,386 | B1 | * | 6/2003 | Thurber et al. | 239/418 |
| 6,581,856 | B1 | * | 6/2003 | Srinath | 239/589.1 |
| 6,805,164 | B2 | * | 10/2004 | Stouffer | 137/833 |

* cited by examiner

*Primary Examiner*—Essama Omgba
(74) *Attorney, Agent, or Firm*—Jim Zegeer

(57) ABSTRACT

Methods of molding fluidic oscillator device having at least a power nozzle for projecting a jet of liquid into an interaction region with an upstream end, opposing side walls, opposing top and bottom walls, and a pair of control ports at the upstream end. The side walls diverge from the power nozzle. A mold cavity is provided in which the power nozzle, interaction region (IR) and control ports can be molded as a core without any seam lines. For a crossover type IR in which the upstream ends diverge and the downstream ends converge to a common throat area and coupled to an outlet aperture, a further mold cavity is provided in which the converging portion of the crossover type interaction region is formed as a second core having a joinder line to the first the core which is transverse to the direction of liquid flow in the fluidic.

7 Claims, 5 Drawing Sheets

METHOD OF MOLDING FLUIDIC OSCILLATOR DEVICES

REFERENCE TO RELATED APPLICATION

The present application is the subject of provisional application Ser. No. 60/273,326 filed Mar. 6, 2001 for NO-SEAL FLUIDIC NOZZLE MANUFACTURING METHOD.

BACKGROUND AND BRIEF DESCRIPTION OF THE INVENTION

Fluidic nozzles have been used in a variety of fluid dispersal applications such as oral irrigators, massaging shower heads, windshield washer nozzles, defrosters, etc. In order to function properly, fluidic oscillators need to have proper sealing so as to not cause leaking across flow channels. The typical construction for the fluidic oscillator has been to fabricate the fluidic circuit in one surface and sealed with another surface. FIG. 1 depicts a crossover-type fluidic element 10 formed in a body member 11. Recesses 13 are typically formed in surface 12 by injection-molding, and a cover plate 16 is placed against a surface to seal the fluidic element. In U.S. Pat. No. 4,185,777, the fluidic circuit element 20 is injection-molded in a chip member 21 which is then sealed by abutting the surface against another member, and in order to prevent leakage, the molded element is force-fitted into a housing 22. (See FIG. 2.) In U.S. Pat. No. 5,213,269, a low-cost, low-pressure feedback free-passage oscillator is disclosed which has no control ports and is molded in one piece 30 with a closure plate 31 hingedly 32 connected to the main body of the device and folded and latched. (See FIG. 3.)

The object of the present invention is to provide a method of molding a fluidic oscillator device having a power nozzle for projecting a jet of liquid into an interaction region having an upstream end, opposing side walls and a pair of control ports at the upstream end, one control port juxtaposed to the respective sides of the interaction region. A mold cavity is provided in which the power nozzle, interaction region and control ports can be molded as a core without any seam lines, and the mold cavity is filled with a solidifieable plastic which is then removed from the mold for use. In this way, all volumetric spaces forming the fluidic element are formed as closed bodies without any seam lines, thereby negating the need for assembling two halves of a fluidic circuit as done in the prior art. The invention also reduces manufacturing process variability due to the no-seal of the fluidic assembly. This also results in a reduction of scrap.

In case of a fluidic oscillator circuit of the type having a crossover interaction region, the interaction region is separated or split transverse to the direction of fluid flow in the interaction region, and the channels and volumetric spaces are designed so that there is no dielock, and the two halves can be separated.

A further object of the invention is to provide a downstream attachment with an exit throat, the attachment being capable of being designed to provide a range of desired output with respect to the extent of oscillation and the inclination of the output jet relative to the body of the fluidic oscillator.

A further object of the invention is to provide a method of constructing a fluidic oscillator device having at least a power nozzle for projecting a jet of liquid into an interaction region with an upstream end, opposing side walls, opposing top and bottom walls, and a pair of control ports at the upstream end, one control port juxtaposed to the respective sides of the interaction region. The side walls diverge from the power nozzle and the control ports having an aperture, the further improvement wherein there is provided top and bottom plates with channels which, with an inertance passthrough or link, form an inertance loop controlling the frequency of oscillation. The body of fluidic is capable of assembly with the top and bottom inertance plates with different lengths of inertance loops, thereby providing oscillations with different operating frequencies.

There is provided a method of constructing fluidic oscillator devices which have a main molded body portion to which may be attached an output exit throat which is capable of being designed to provide a range of desired outputs with respect to the extent of oscillations and the inclination of the output relative to the body of the fluidic oscillator and which is also capable of having inertance plates with channels therein which form inertance loops for controlling the frequency of oscillation.

A further object of the invention is to provide a method of manufacturing a fluidic element in which tooling the fluidic by changing the injection mold tooling is easier and less costly with this method.

In the case of the crossover type fluidic oscillator being formed, the assembly work involves joining the front half of the fluidic formed as a core to the rear half of the fluidic oscillator joining its two external inertance plates to the body of the fluidic. Both these actions can be considered external to the main part of the fluidic (power nozzle-control port-interaction region areas). The method also allows for the same fluidic to be assembled with different inertance plates, resulting in different operating frequencies. Similarly, the fluidic can be paired with different exit throats resulting in many different spray formats.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 5:
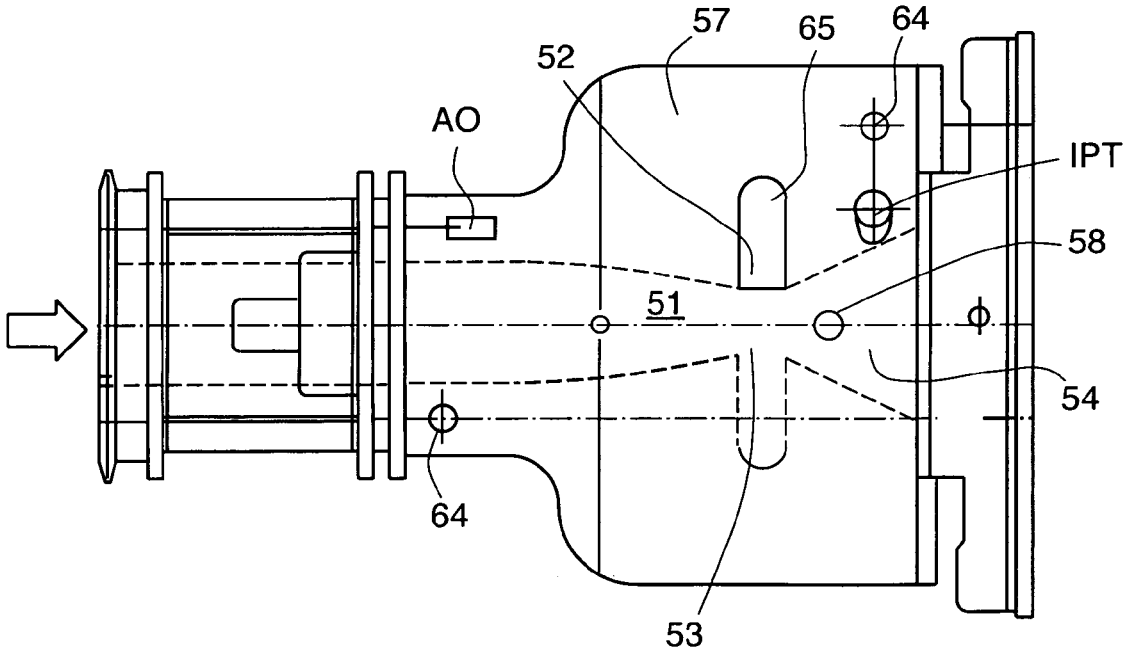
FIG. 5 is a sectional view of the fluidic oscillator showing the part which would be molded in one piece as a molded core without any seam lines and includes the element forming the power nozzle, control ports and interaction region.
Figure 4:
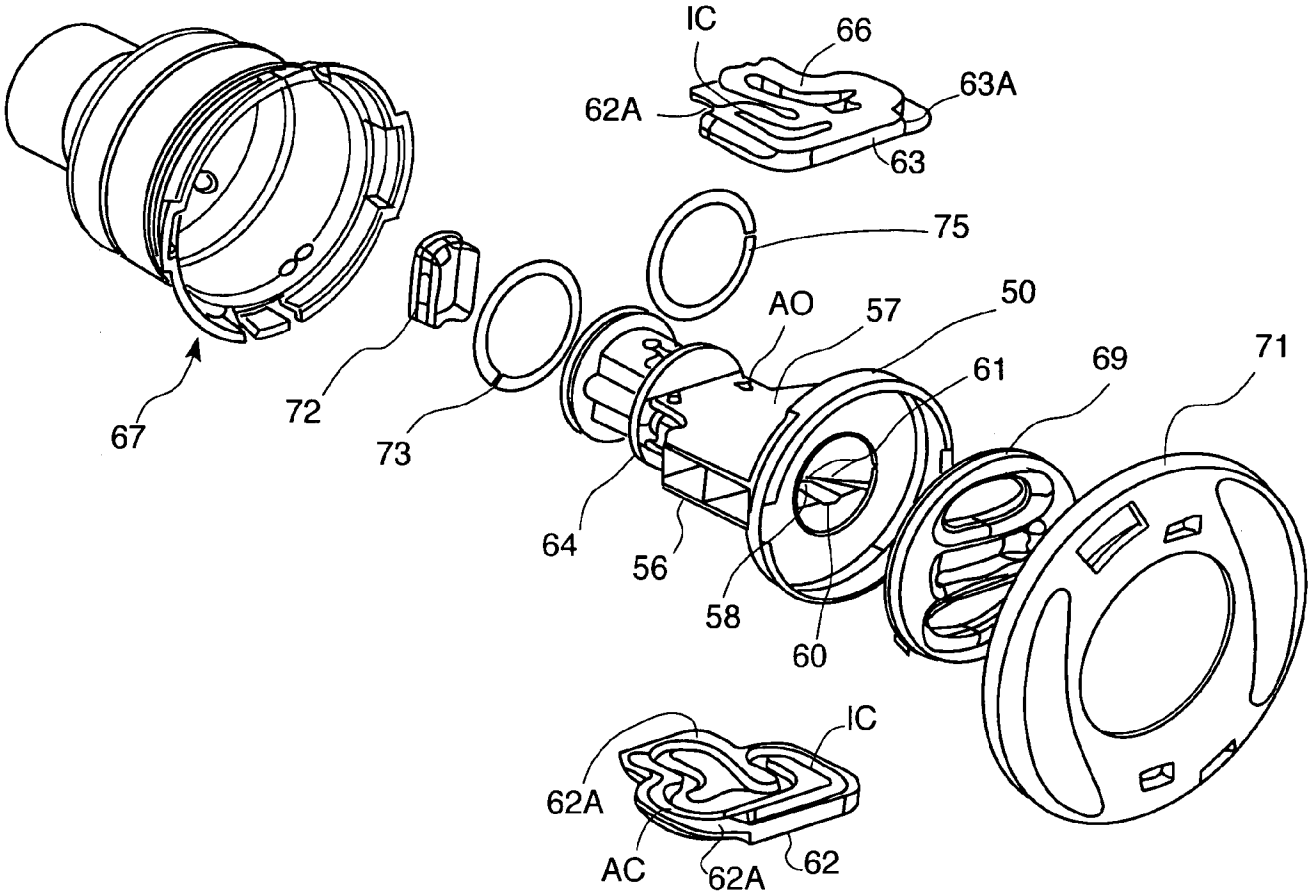
FIG. 4 is an exploded perspective view of a preferred fluidic oscillator device as formed in accordance with the practice of the present invention.

Referring to FIGS. 4 and 5, there is disclosed an integrally molded fluidic body 50 containing the fluidic oscillation circuit shown in FIG. 5. The fluidic oscillator includes power nozzle 51, a pair of control ports 52, 53, and an interaction region 54 which constitute the volumetric spaces which form the fluidic elements and, as discussed earlier, are formed without seam lines and thereby negating the need for assembling two halves of the fluidic or by flat cover surfaces and the like. The fluidic oscillator shown in FIG. 5 has upper and lower walls 56, 57. In the outlet region, the upper and lower walls are provided with air inlet ports 58 which aspirate air and are provided with downstream extending aspiration enhancing ramps 60, 61. The circuitry shown in FIG. 5 and constituted by element 50 is all formed in a mold cavity without seam lines. The mold cavity filled with a solidifieable plastic by injection molding, for example, which is then removed from the mold for use. It will be appreciated that various elements in the molding process such as the technique for inserting steel mold elements to form the volumetric spaces 51, 52, 53, 54 are well known in the art.

Two inertance plates 62, 63 for the top and bottom of the fluidic oscillator body member 50 are provided. These inertance plates 62, 63 are provided with inertance channels IC which couple with the inertance passthrough IPT, form an inertance loop for controlling the frequency of oscillation. The body of the fluidic oscillator 50 is capable of assembly with top and bottom inertance plates 62, 63 with different lengths and cross-sectional areas, thereby providing oscillation with different operating frequencies. Inertance loop plates 62 and 63 are molded separately and provided with mounting apertures 62*a*, 63*a* which fit on guides 64 (only one shown). Ports or openings 65 (one on each side) couple the control ports 52, 53 to the inertance loop. The two inertance plates 62 and 63 connect directly through to the ends of each other by way of an inertance loop passage IPT. Thus, the ends of the inertance loop 62, 63 are connected to each other via inertance loop passage ILP and are connected to the control ports by apertures. Opening AO is an air passage which couples with an air channel AC, formed on the inertance plates 62, 63. Air channels AC have an end which fits over air passage AO and an end which fits over air inlet port 58. The flange plates 56, 57, on which the inertance loop plates 62, 63 are fastened and adhered, seal the bottom half of the inertance loop.

For the purposes of the present invention, the remaining components illustrated in FIG. 4 are not pertinent to the invention. Element 67 is a shut-off structure, element 69 is a mode disc which controls the oscillatory state of the oscillator (e.g. oscillating and not oscillating by blocking portions of the outlet). Element 71 is a handle and escutcheon member for carrying the logos and the like of various entities. Element 72 is an air chamber plug which separates air passages from water passages. Element 73 is an O-ring seal, and element 75 is a sealing ring.

Figure 1:
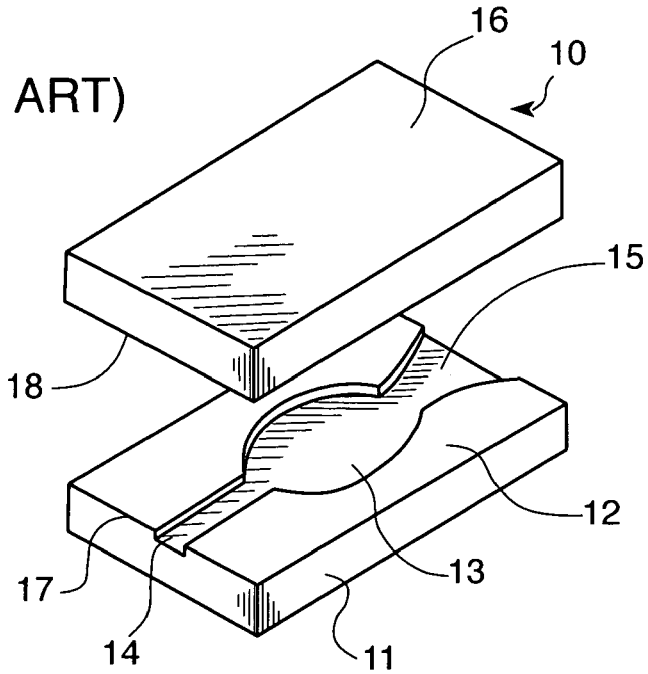
FIG. 1 (PRIOR ART)
FIG. 1 is an exploded perspective view of a prior art fluidic spray device.
Figure 2:
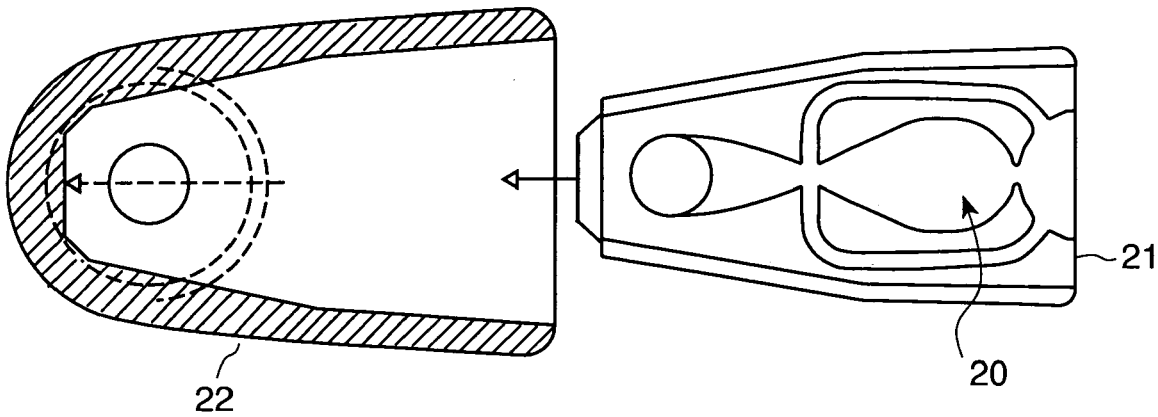
FIG. 2 (PRIOR ART)
FIG. 2 is a exploded view of a fluidic oscillator assembly technique as disclosed in U.S. Pat. No. 4,185,777 (FIG. 11)
Figure 3:
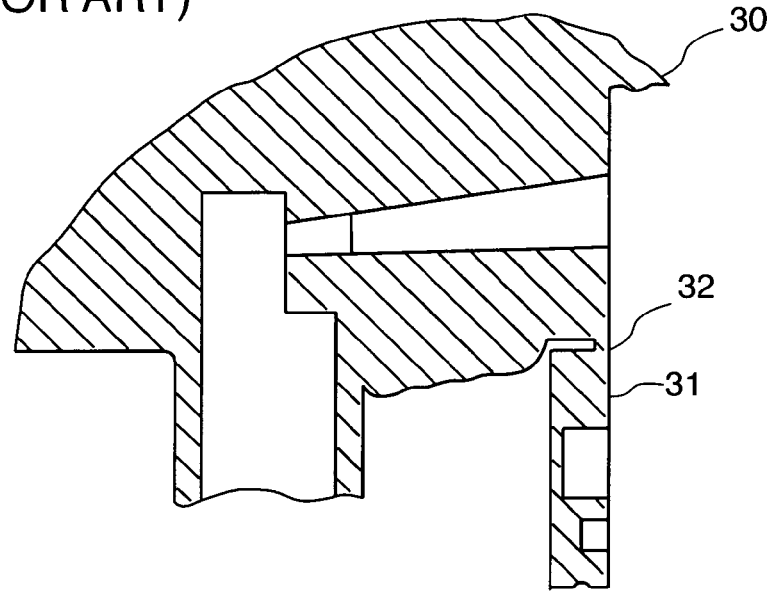
FIG. 3 (PRIOR ART)
FIG. 3 is a sectional view of a fluidic spray device disclosed in U.S. Pat. No. 5,213,269.
Figure 6:
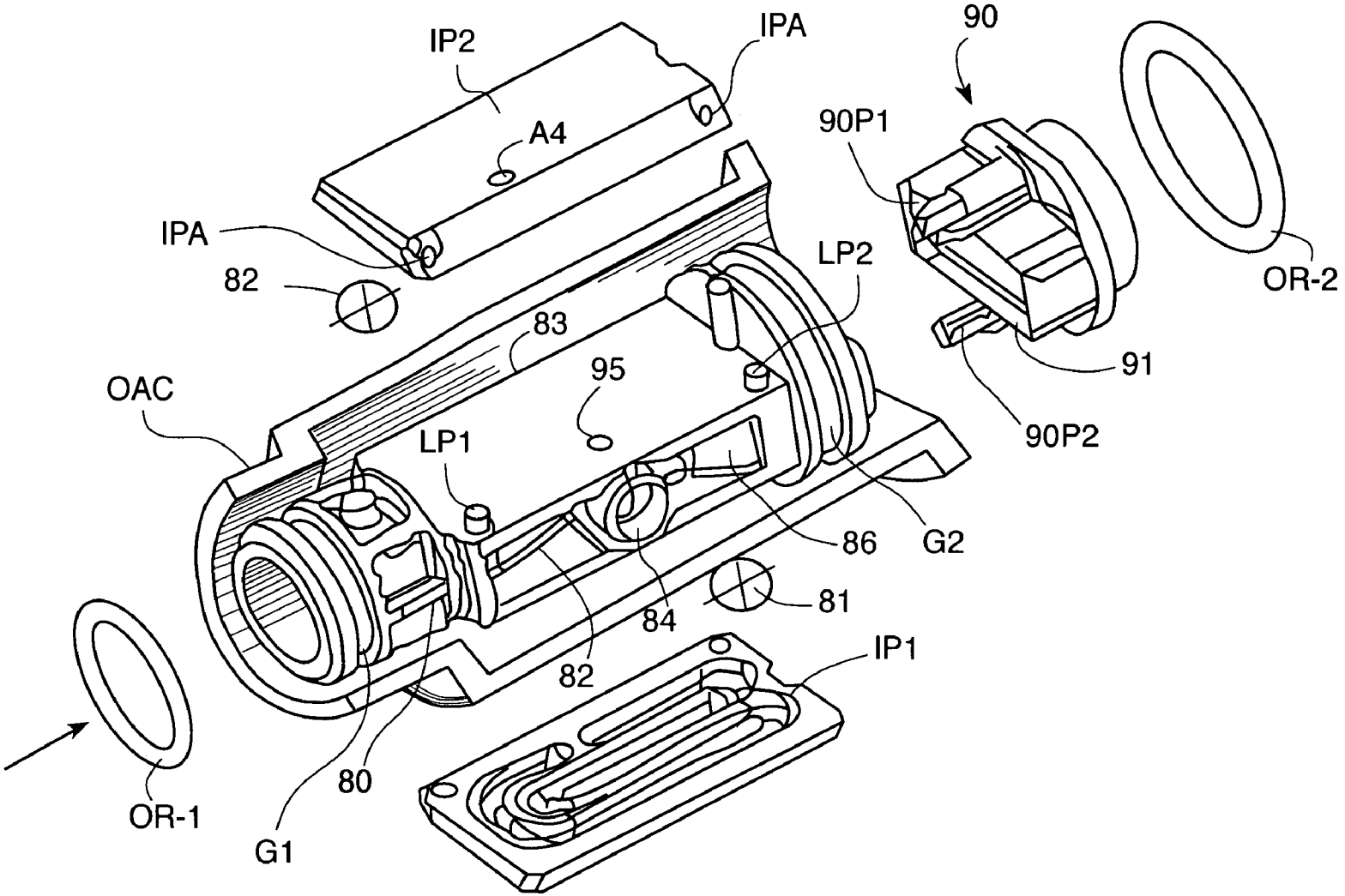
FIG. 6 is a exploded view of a further device made in accordance with the method of this invention.
Figure 7:
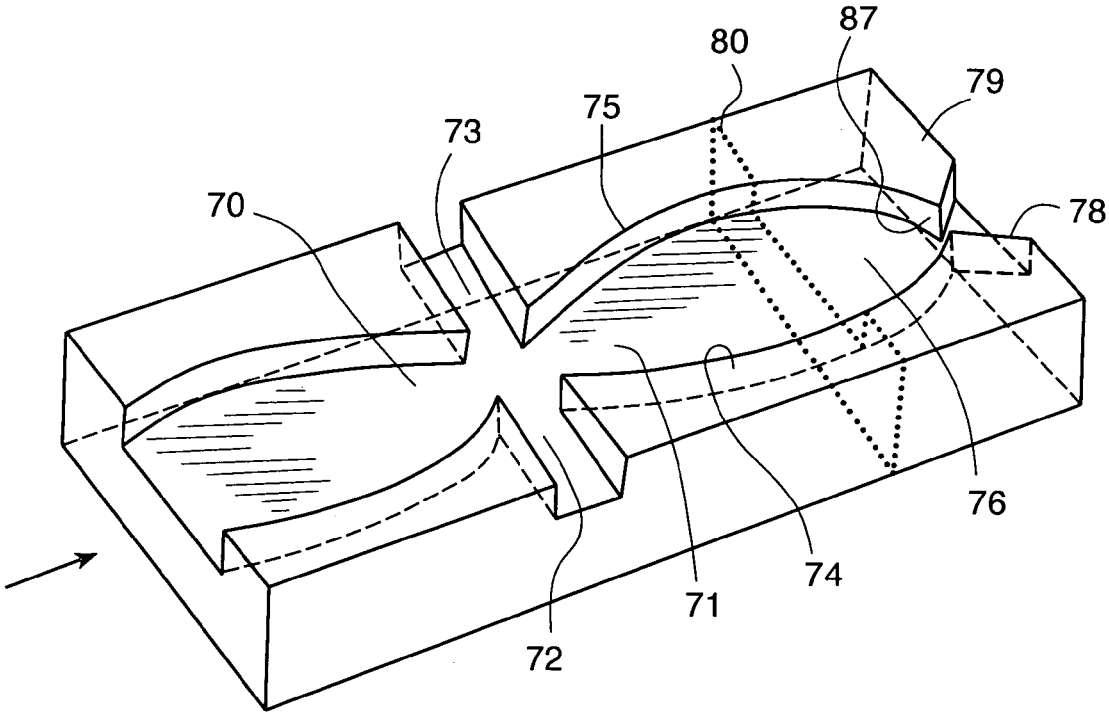
FIG. 7 is a isometric view of the invention showing the separation of the fluidic circuit in FIG. 6 for molding purposes in accordance with the principles of this invention.

Referring to the embodiment disclosed by FIG. 6, the fluidic circuit per se is diagrammatically illustrated in FIG. 7 and includes a power nozzle 70 projecting a jet of water into an interaction region 71 past a pair of control ports 72, 73 which are juxtaposed at the upstream end of the interaction region 71 and to respective sides thereof. The interaction region shown in FIG. 7 is of the cross-over type in which the side walls 74, 75 first diverge from the power nozzle 70 and then gradually converge to a throat region 76 and to an outlet 77 having a pair of diverging walls 78, 79. In prior art techniques for manufacturing a fluidic device of FIG. 7, the fluidic previously was executed in two molded halves and fitted together or by techniques shown in FIGS. 1–3. However, according to the present invention, the fluidic is effectively molded in two parts separated along the lines 80 shown in dotted lines in FIG. 7. Thus, the downstream throat region 77 is molded separately from the upstream interaction region (e.g. the main portion thereof). Referring now to FIG. 6, the fluidic body 80 is molded as an integral unit having an input for water or other liquids 81 feeding a power nozzle 82. A pair of control ports (only one shown) 83, 84 (72, 73 in FIG. 7) are at the upstream end of a pair of diverging side walls 86, 87. The outer ends of the control ports are plugged or blocked by ball members B1 and B2. A downstream attachment element 90 is formed with the volumetric space constituting an exit throat 91 (which corresponds to exit throat 77 in FIG. 7) and an outlet aperture corresponding to outlet aperture 78 having diverging side walls corresponding to diverging side walls 78 and 79. The fluidic oscillator shown in FIG. 6 is provided with upper and lower plates 93, 94 which have apertures 95 (and a further aperture for the other control port). Top and bottom inertance loop plates 96, 97 are provided with inertance loop passages IP1, IP2 (IP2 not visible in FIG. 6) which have an end E which is positioned over hole 95. Locating pins LP1 and LP2 are fitted on apertures IPA1, IPA2 so as to accurately locate the inertance plates IP1 and IP2 precisely over the holes 95.

An outer annular chamber OAC is provided to fit over the fluidic assembly and is sealed by a pair of O-rings OR1 and OR2 which fit in grooves G1 and G2, respectively.

The downstream attachment unit 90 is provided with a pair of rearwardly projecting pins 90P1, 90P2 which are received holes in the end of the fluidic unit 80 and therefore properly position and locate the downstream attachment with the exit throat on 91 in proper alignment and fitment with the main body 80.

There is an aperture A4, A5 (A5 not shown) in each inertance IP1 and IP2 which communicates via the liquid stored in the chamber surrounding the fluidic and sealed by the seal rings OR1 and OR2 so that the ends of the inertance loops are coupled to each other.

While the invention has been described in relation to preferred embodiments of the invention, it will be appreciated that other embodiments, adaptations and modifications of the invention will be apparent to those skilled in the art.

What is claimed is:

1. A method of making a fluidic oscillator device having at least a power nozzle for projecting a jet of liquid into an interaction region with an upstream end, opposing side walls, opposing top and bottom walls, and a pair of control ports at the upstream end, one control port juxtaposed to the respective sides of said interaction region, an inertance loop passage and an inertance loop connecting said pair of control ports, said opposing side walls diverging from said power nozzle, comprising:

providing a mold cavity in which said power nozzle, interaction region and control ports can be molded as a core without any seam lines, filling said mold cavity with a solidifieable plastic, removing said core from said mold cavity, and providing top and bottom inertance plates with channels which form an inertance loop with said inertance loop passage and connecting said pair of control ports for controlling the frequency of oscillation, the said body of the fluidic oscillator device being capable of assembly with top and bottom inertance plates with different lengths of inertance loops, thereby providing oscillations with different operating frequencies.

2. A fluidic oscillator made according to the method defined in claim 1.

3. A method defined in claim 1 wherein said interaction region is of the crossover type having a downstream end and in which the upstream end diverge and the downstream end converge to a common throat area and coupled to an outlet aperture, the further improvement comprising providing a further mold cavity in which said converging portion of said crossover type interaction region is formed as a second core having a joinder line to the first said core which is transverse to the direction of liquid flow in said fluidic, filling said further mold cavity with a solidifieable plastic, and removing said second core from said further mold cavity and joining said cores along said joinder line.

4. A fluidic oscillator made according to the method of claim 3.

5. A method of molding a fluidic oscillator having at least a power nozzle for projecting a jet of liquid into an interaction region with upstream and downstream ends, opposing side walls, opposing top and bottom walls, and a pair of control ports at the upstream end of said interaction region, one control port juxtaposed to the respective sides of said interaction region, said side walls diverging from said power nozzle comprising:

providing a first mold cavity in which said power nozzle, the upstream end of said interaction region and control ports are molded as a core without any seam lines, providing a second mold cavity in which the downstream end of said interaction region includes an exit throat, can be molded as a core without any seam lines, filling said mold cavities with a solidifieable plastic, and removing said cores from said mold cavities, and joining said cores together along a line which is transverse to the direction of liquid flow through the oscillator.

6. The method defined in claim 5, said fluidic oscillator has an inertance loop passage, including:

providing top and bottom inertance plates with channels which form an inertance loop with said inertance loop passage connecting said pair of control ports for controlling the frequency of oscillation, the said body of the fluidic oscillator device being capable of assembly with top and bottom inertance plates with different lengths of inertance loops, thereby providing oscillations with different operating frequencies.

7. A fluidic oscillator made according to the method defined in claim 6.

* * * * *